US005715807A

United States Patent [19]

Toyama et al.

[11] Patent Number: 5,715,807

[45] Date of Patent: Feb. 10, 1998

[54] WIRE SAW

[75] Inventors: Kouhei Toyama, Sirakawa; Etsuo Kiuchi, Gunma-gun; Kazuo Hayakawa, Takasaki, all of Japan

[73] Assignees: Shin-Etsu Handotai Co., Ltd., Chiyoda; Mimasu Semiconductor Industry Co., Ltd., Gunma, both of Japan

[21] Appl. No.: 628,038

[22] Filed: Apr. 4, 1996

[30] Foreign Application Priority Data

Apr. 14, 1995 [JP] Japan ..... 7-089101

[51] Int. Cl.[6] ..... B28D 1/08

[52] U.S. Cl. ..... 125/16.02; 125/21

[58] Field of Search ..... 83/651.1; 125/12, 125/16.02, 21

[56] References Cited

U.S. PATENT DOCUMENTS

| | | | |
|---|---|---|---|
| 3,831,576 | 8/1974 | Mech | 125/21 X |
| 4,574,769 | 3/1986 | Ishikawa | 125/21 X |
| 4,640,259 | 2/1987 | Shimizu | 125/21 X |
| 5,201,305 | 4/1993 | Takeuchi | 125/21 |
| 5,564,409 | 10/1996 | Bonzo et al. | 125/16.02 X |

FOREIGN PATENT DOCUMENTS

| | | | |
|---|---|---|---|
| 0 261 695 | 3/1988 | European Pat. Off. . | |
| A-52-98291 | 8/1977 | Japan . | |
| A-2-160468 | 6/1990 | Japan . | |
| 89/01395 | 2/1989 | WIPO | 125/21 |

*Primary Examiner*—Timothy V. Eley
*Attorney, Agent, or Firm*—Oliff & Berridge, P.L.C.

[57] ABSTRACT

A wire saw for slicing a semiconductor single crystal ingot with which alignment of the crystallographic orientation of the ingot is simple and easy in a slicing process and a method for slicing the ingot by means of the wire saw. Main rollers are three-dimensionally arranged with a predetermined distance between each other, and a wire runs over the main rollers to form arrays of wire portions parallel to each other, with said wire saw an ingot being sliced into rods by pressing it to an array of wire portions between a pair of main rollers that are used to slice the ingot, while the wire is being driven and slurry is fed to the array of wire portions between the pair of main rollers, wherein the wire runs over the pair of main rollers used for slicing in a ratio of one turn over the pair of main rollers to more than one turn over the other main roller or rollers so that the array of wire portions running over the pair of main rollers used for slicing can be arranged at a desired pitch.

20 Claims, 9 Drawing Sheets

WIRE SAW

BACKGROUND OF THE INVENTION

1. Field of the Invention

The present invention relates to an improvement on a wire saw, and more particularly, relates to a new wire saw best used for slicing a semiconductor single crystal ingot (hereinafter sometimes simply referred to as ingot) into rods.

2. Related Prior Art

A semiconductor single crystal ingot is usually sliced into rods of a predetermined length each, because there arises restrictions in handling the ingot as it is for processing. In order to slice the ingot into rods, slicing machines such as an outer peripheral slicing machine, an inner peripheral slicing machine and a wire saw have been heretofore used.

Among the slicing machines above mentioned, the outer peripheral slicing machine and the inner peripheral slicing machine have blades each of which is made of a thin metal plate such as a stainless steel thin plate and has diamond grains fixed by electroforming along a periphery thereof. A blade of the outer peripheral slicing machine is about 2.5 mm thick as the thinnest available. A blade of the inner peripheral slicing machine is about 0.5 mm thick. A band saw has a function to slice a workpiece with abrasive grains being fed on a band-like thin plate made of stainless steel or the like and the thin plate is about 0.7 mm thick. The blade thickness of each slicing machine will be required progressively thicker as the diameter of a semiconductor single crystal ingot grows larger in the future. Production of a blade will then become extremely difficult or may become impossible specially in the case of an inner peripheral slicing machine.

Kerf loss in slicing an ingot becomes larger as the diameter is larger, since the thickness of the blade in each of these slicing machines becomes lager. The kerf loss will then become as large as can not be neglected.

A bias in crystallographic orientation of the growth axis from a low indices direction is one of important specifications which cannot be neglected when considering slicing of an ingot into wafers. An inclination of the central axis of a growing ingot relative to the growth direction amounts to ±2° as the largest which happens.

However, in a apparatus available at present which is specialized for slicing an ingot into shorter rods, there is not mounted a mechanism for aligning a crystallographic orientation of the ingot, that is, a mechanism for tilting the ingot in two ways, one of which is toward a first direction perpendicular to the longitudinal axis of the ingot and the other is toward a second direction perpendicular to both the longitudinal axis and the first direction. The ingot is therefore sliced into shorter rods the long axis of which still inherit a bias or error from the growth direction which bias the as-grown ingot originally had, because the ingot is aligned in terms of crystallographic orientation in the apparatus referring to the outer surface of the ingot cylindrically ground. In such a situation, slicing a wafer or wafers by way of trial from each rod is indispensable for aligning correctly in terms of crystallographic orientation, the longitudinal axis of the ingot to produce wafers with a correct crystallographic orientation in an actual production. Besides, another slicing kerf loss cannot be avoided at the other end of each rod due to the biased long axis in terms of crystallographic orientation. The total loss of those combined at both ends of each rod reaches some percents.

In reference to FIGS. 14 to 17, a conventional process for slicing an ingot into shorter rods will be described. The steps of the process are as follows: A single crystal G is grown (hereafter referred to as grown single crystal) (FIG. 14), wherein the long axis of the growing ingot is biased at a maximum of ±2° C. relative to an intended growth orientation. Cylindrical grinding is applied to the as grown single crystal G along the length to adjust the diameter to a desired uniform diameter (FIG. 15). Slicing off of abnormal parts is conducted by means of an inner peripheral slicing machine, an outer peripheral slicing machine, a band saw, or the like, the abnormal parts being usually of smaller diameters than a predetermined diameter, which are usually the parts of the first growing portion or a cone and last growing portion of the ingot or a tail. On this occasion, the rods keeps the inherited errors of ±2° as the maximum in crystallographic orientation, since no measurement of crystallographic orientation is carried out. Shorter rods such as R are sliced from the residual, main portion of the ingot G in succession (FIG. 16). Both end surfaces of each rod R is biased in the range of ±2° from a desired crystallographic plane and therefore kerf loss in wafer slicing as mentioned above is unavoidable for each rod R.

When a wafer with a standard tolerance in crystallographic specification of ±1° is aimed, the specification have to be an error of within ±30' in actual production.

A rod R is put into a continuous slicing step to obtain wafers W as production by means of an inner peripheral slicing machine after a wafer or wafers MW for measuring the crystallographic orientation are by way of trial sliced at an end of the rod and the longitudinal axis of the rod is adjusted by tilting in the two ways as mentioned above on the basis of the measurement. When a rod R is sliced into wafers W by means of a conventional method, the kerf loss N from a wafer or wafers used for measuring a crystallographic orientation at one end and from the unused portion at the other end is caused by an inclination of the longitudinal axis from a growth direction (FIG. 17).

Such measurement of a crystallographic orientation and the following adjusting of a rod axis makes the process complex and thereby operators have a chance to incorrectly adjust the crystallographic orientation of a rod, so that a tremendous damage can arise.

A conventional wire saw is used for slicing a rod obtained from an ingot into wafers or thin disks. A conventional wire saw 2 comprises three or four resin-made rollers 4*a*, 4*b*, 4*c* having the same structure and materials which are called main rollers and which are arranged three-dimensionally parallel to each other, each roller 4*a*, 4*b*, 4*c* having annular grooves 6*a*, 6*b*, 6*c* formed at a constant pitch on the peripheral surfaces. A wire 8 is running through the inside of each of the grooves 6*a*, 6*b*, 6*c* of the rollers 4*a*, 4*b*, 4*c* (FIG. 18).

An end of the wire 8 and the neighboring portion winds around a take-up drum 10 and the other end of the wire 8 and the neighboring portion also winds round a take-up drum 12. Tension adjusting mechanisms 14, 16 are respectively located near the take-up drums 10, 12, which take-up respectively the start end and finish end of the wire 8 to adjust the tension thereof.

The rotation of the drive roller 4*a* which is mechanically connected to and actuated by a drive-motor M is transmitted to the roller 4*b* and to the roller 4*c* by way of the wire 8. A workpiece such as a rod R having been sliced from a semiconductor single crystal ingot is fixed by adhesive on a workpiece holder 18 that is freely shiftable vertically. The rod R is pressed to the wire 8 on which a slurry is fed from thereabove by shifting down the workpiece holder 18. Thereby it is sliced into wafers W in the course of repeating the motion.

However, when the number of the grooves on the periphery of each of the main roller 4*a*, 4*b*, 4*c* is low, that is, the number of the wire portions running between the rollers 4*a*, 4*b*, 4*c* is lower, the torque from the drive roller 4*a* is transmitted short to rotate the rollers 4*b*, 4*c* due to a mechanical limit of the wire to resist the tension arising in itself, which causes breaking down, or slippage between the wire and each of the rollers 4*b*, 4*c* if the wire is strong enough to mechanically resist the tension.

A typical case of a low number of the grooves can be envisioned as a case that shorter rods are sliced from an ingot or a longer rod.

The pitch of the grooves on the main roller 4*a*, 4*b*, 4*c* is limited by the distances between the same rollers. In detail, when the distances between the rollers 4*a*, 4*b*, 4*c* are smaller, but the pitch is selected larger, the wire 8 rubs in excess against a wall of the groove next to a groove in which the wire 8 has been or it goes outside a groove in the next turn.

The wire 8 can be broken down by strongly rubbing a groove wall or it goes outside the next groove to slacken the same wire 8. A pitch of the grooves is limited to the maximal value of about 5.0 mm in the case of a common wire saw.

According to the past technology relating to the wire saw, even when rods of 50 mm long are sliced from a semiconductor single crystal ingot, the distance between rollers have to be extremely large in a conventional wire saw. The distance cannot be large without limitation, since the size of the machine becomes extremely large and there arises another limitation from the fact that the resistance of a wire against the tension generated in itself is not so large. For example, slicing an ingot of 800 mm long into three to four rods is altogether impossible with a conventional wire saw.

SUMMARY OF THE INVENTION

In light of the above problems which the conventional technology had, the present invention was made to solve them. It is an object of the present invention to provide a wire saw which makes it possible to slice a semiconductor single crystal ingot into rods with no limitation to a length thereof and a method for slicing a semiconductor single crystal ingot into rods by means of the wire saw.

It is another object of the present invention to provide a wire saw with which kerf loss in slicing is reduced and the yield of slicing is improved and a method for slicing a semiconductor single crystal ingot into rods by means of the wire saw.

It is a further object of the present invention to provide a wire saw for slicing an ingot into rods with which it is made simple and easy to adjust the crystallographic orientation of each rod in a following step of producing wafers and a method for slicing an ingot into rods by means of the wire saw.

In order to solve the above problems, a wire saw according to the present invention comprises main rollers three-dimensionally arranged with a predetermined distance between each other, and a wire running over the main rollers to form arrays of wire portions parallel to each other between any two of the rollers. A workpiece is cut into rods with said wire saw by pressing the workpiece to an array of the wire portions between a pair of main rollers while the wire is being driven and slurry is fed to the array of the wire portions between the pair of main rollers, wherein any of the arrays of wire portions can be used for cutting the workpiece and in the above case, the wire runs between the pair of main rollers a plurality of times in a ratio of one time between the pair of main rollers to more than one time over the other main roller or rollers with a desired constant distance spaced between each pair of successive wire portions along the pair of main rollers.

The case of three main rollers being used is similar to the case of four main rollers being used in that a workpiece having a longitudinally extended axis is, during cutting, in pressed contact with an array of wire portions between a pair of main rollers in a position perpendicular to the array of the wire portions and the array of wire portions between the pair of main rollers is directly used for cutting the workpiece into a plurality of rods each of a desired length.

The wire winds around all of the main rollers in an engaged manner on outer cylindrical surfaces a plurality of times. The other main roller or rollers are exclusively wound by the wire an additional number of times relative to the number of times the pair of main rollers in the cutting area is wound by the wire. Each time the wire winds around the pair of main rollers in the cutting area, the wire successively winds around the other main roller or rollers one or more times. In the case of two or more other main rollers, the wire winds around the other main rollers as a group.

In the case of three main rollers being used, the other main roller is wound by the wire in more turns than the pair of main rollers in the cutting area. In the case of four main rollers being used, the two other main rollers are wound by the wire in more turns than the pair of main rollers in the cutting area.

In the case of the three main rollers according to the present invention, each of the pair of main rollers in the cutting area has a plurality of grooves along the peripheral surface at a pitch (distance between grooves) and the other main roller has no groove in the peripheral surface. The pitch of grooves along the peripheral surface of each of the pair of main rollers in the cutting area can be adjustable by winding the wire around the other grooveless main roller in more turns. In the case of the four main rollers according to the present invention, a pair of other main rollers each have grooves formed at a pitch of 5 mm or less along the peripheral surface. A pitch of arrays of grooves along the peripheral surface of each of a pair of main rollers in the cutting area can be adjustable by the cooperative use of the other pair of main rollers by winding the wire around the other pair of main rollers a plurality of times before it goes to the pair of main rollers in the cutting area.

With a mechanism for aligning crystallographic orientation mounted in the wire saw according to the present invention, sliced rods R advantageously make it simple and easy to adjust the crystallographic orientation of each rod in a following wafer slicing process and at the same time to reduce kerf loss in slicing to a great degree.

When using a wire of a diameter in the range of 0.16 mm to 0.32 mm in a wire saw, kerf loss in slicing an ingot into rods can be further reduced to a very small amount.

A semiconductor single crystal ingot used in the present invention is prepared through growing it in a crystal grower and processing it by a cylindrical grinder.

BRIEF DESCRIPTION OF THE DRAWINGS

The novel features which are considered characteristic of the present invention are set forth with particularity in the appended claims. The present invention itself, however, and additional objects and advantages thereof will best be understood from the following description of embodiments thereof when read in connection with the accompanying drawings, in which:

DETAILED DESCRIPTION OF THE INVENTION

Below, description will be given about an embodiment according to the present invention in reference to FIGS. 1 and 13.

Figure 1:
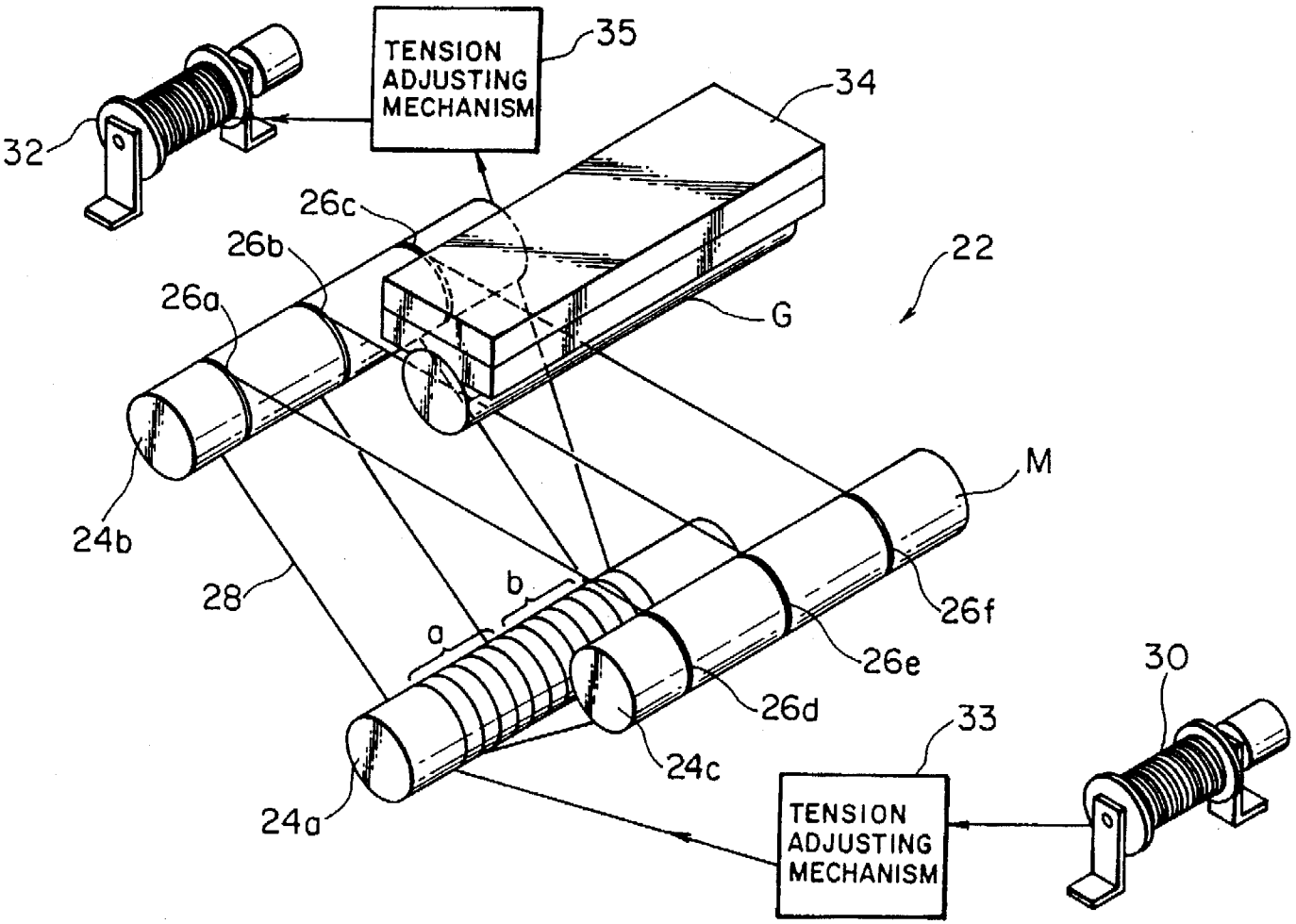
FIG. 1 is a schematic, perspective view illustrating an embodiment of the wire saw according to the present invention.

In FIG. 1, a wire saw according to the present invention is indicated at 22. the wire saw comprises three main rollers 24*a*, 24*b*, 24*c* arranged in a space in such a manner that their axes are parallel to each other and respectively located at the three apexes of a triangle in a sectional plane. In the surfaces of the main rollers 24*b*, 24*c* a first group of annular grooves 26*a*, 26*b*, 26*c* and a second group of 26*d*, 26*e*, 26*f* are respectively formed in such a manner that each of the first group corresponds to one of the second group. The distance between an annular groove and the next annular grove on the same main roller is called the pitch of the grooves. The magnitude of the pitch of each group of the annular grooves 26*a* to 26*f* is chosen in such a manner that rods of a desired length can be sliced. According to the present invention a larger pitch is chosen compared with a pitch at which thin wafers are sliced.

Figure 3:
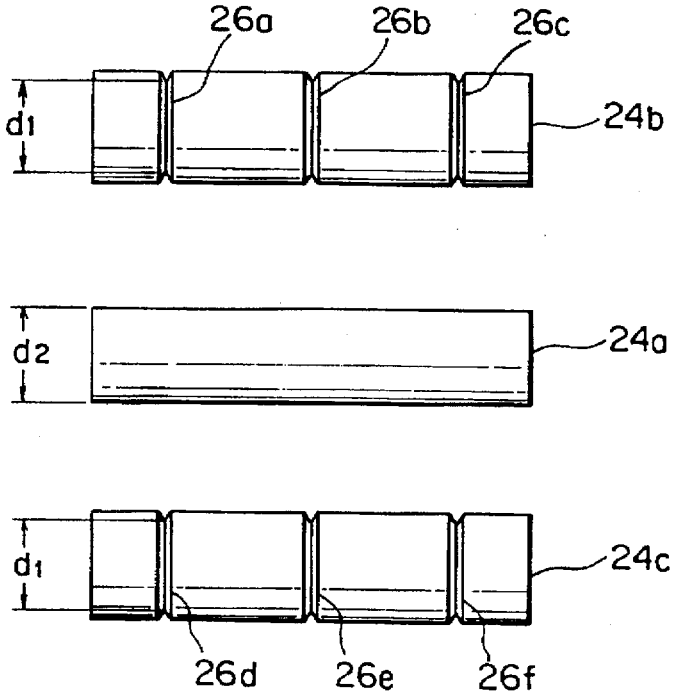
FIG. 3 is a schematic plan view of the main rollers three-dimensionally arranged shown in FIG. 1.

Annular grooves are not formed in the peripheral surface of the drive roller 24*a* which is mechanically connected with and actuated by a drive motor M. The diameter $d_1$ of a circumscribed circle in a plane perpendicular to the axes of the rollers 24*b*, 24*c* the periphery of which includes the projections of all the deepest points of the bottoms of each group of the annular grooves 26*a* to 26*f* in the surfaces of the main rollers 24*b*, 24*c* is equal to the diameter $d_2$ of the grooveless roller 24*a* (FIG. 3).

A wire 28 is running from the roller 24*a* to the groove 26*a* of the roller 24*b*, to the groove 26*d* of the roller 24*c*, and to the grooveless roller 24*a*.

The wire 28 turns a plurality of times around the grooveless roller 24*a* through part a and thereafter runs in the groove 26*b* of the roller 24*b*. It further turns over the roller 24*c* in the groove 26*e* after coming out of the groove 26*b* of the roller 24*b*. It again goes to the grooveless roller 24*a* to turn thereround a plurality of times through part b and then run over the roller 24*c* in the groove 26*f* by way of the groove 26*c* of the roller 24*b*.

In such a manner as mentioned above, even when the pitch of rollers 24*b*, 24*c* is larger, tranferring of the wire 28 between the grooves at a desired pitch becomes possible by winding the wire around the grooveless roller 24*a* a desired number of times. Accordingly, breaking-down or skipping over a groove or grooves of the wire 28 can be prevented.

A number of times which the wire winds around the grooveless roller 24*a* is not restricted, but it can be preferable to choose the number so that when the wire 28 winds around the annular grooves 26*a* to 26*f* which are formed in the peripheral surface of the rollers 24*b*, 24*c*, it may neither abrade a wall of each of the annular grooves 26*a* to 26*f* in an excessive degree nor go out of them. If the number of winds is properly chosen, the wire 28 winds around the grooveless roller 24*a* through a distance along the length of the roller 24*a* until it reaches a point which corresponds to each of the annular grooves 26*b*, 26*c*, 26*e*, 26*f* of the rollers 24*b*, 24*c* and advances to each of the annular grooves 26*b*, 26*c*, 26*e*, 26*f* along a direction of almost a right angle relative to the rollers 24*b*, 24*c*.

A starting end of the wire 28 is wounded around a take-up drum 30 and a finishing end of the wire 28 is wound around another take-up drum 32. Tension adjusting mechanisms designated at 33, 35 are located near the take-up drums 30, 32 to adjust a tension in the wire 28.

Figure 2:
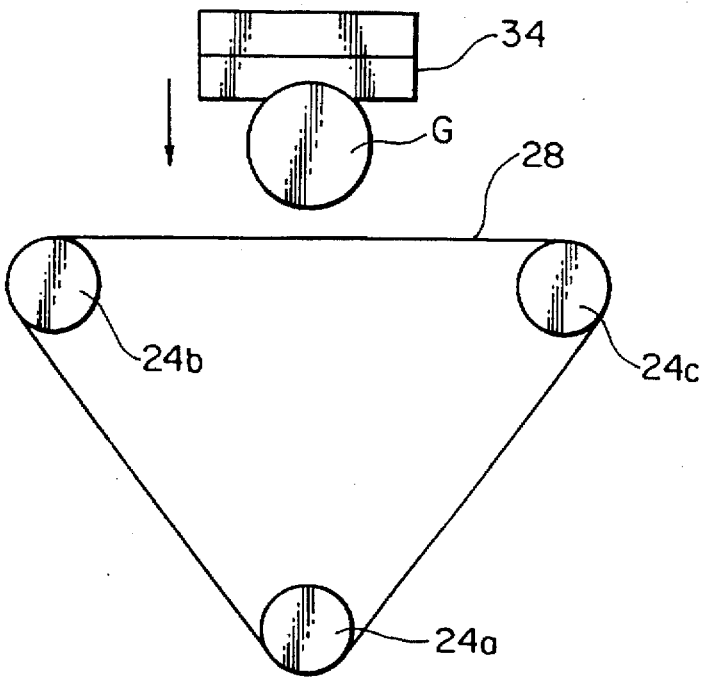
FIG. 2 is an illustrative presentation, as viewed from one end, of the arrangement of main rollers and an ingot shown in FIG. 1.

The torque from the drive roller 24*a* which is mechanically connected to and actuated by the drive motor M is transmitted by way of the wire 28, a drive belt not shown and the like to the rollers 24*b*, 24*c*. The workpiece such as a semiconductor single crystal G is fixed with adhesive to the workpiece holder 34 which is freely shiftable vertically. The ingot G is pressed to the wire 28 from above by shifting down the workpiece holder 34 and thereby it is cut into rods, while slurry is being fed on the wire 28 (FIG. 2).

The groove pitch of the rollers 24*b*, 24*c* is freely adjusted by winding the wire 28 around the grooveless roller 24*a*. Thereby rods of any length can be cut.

Figure 4:
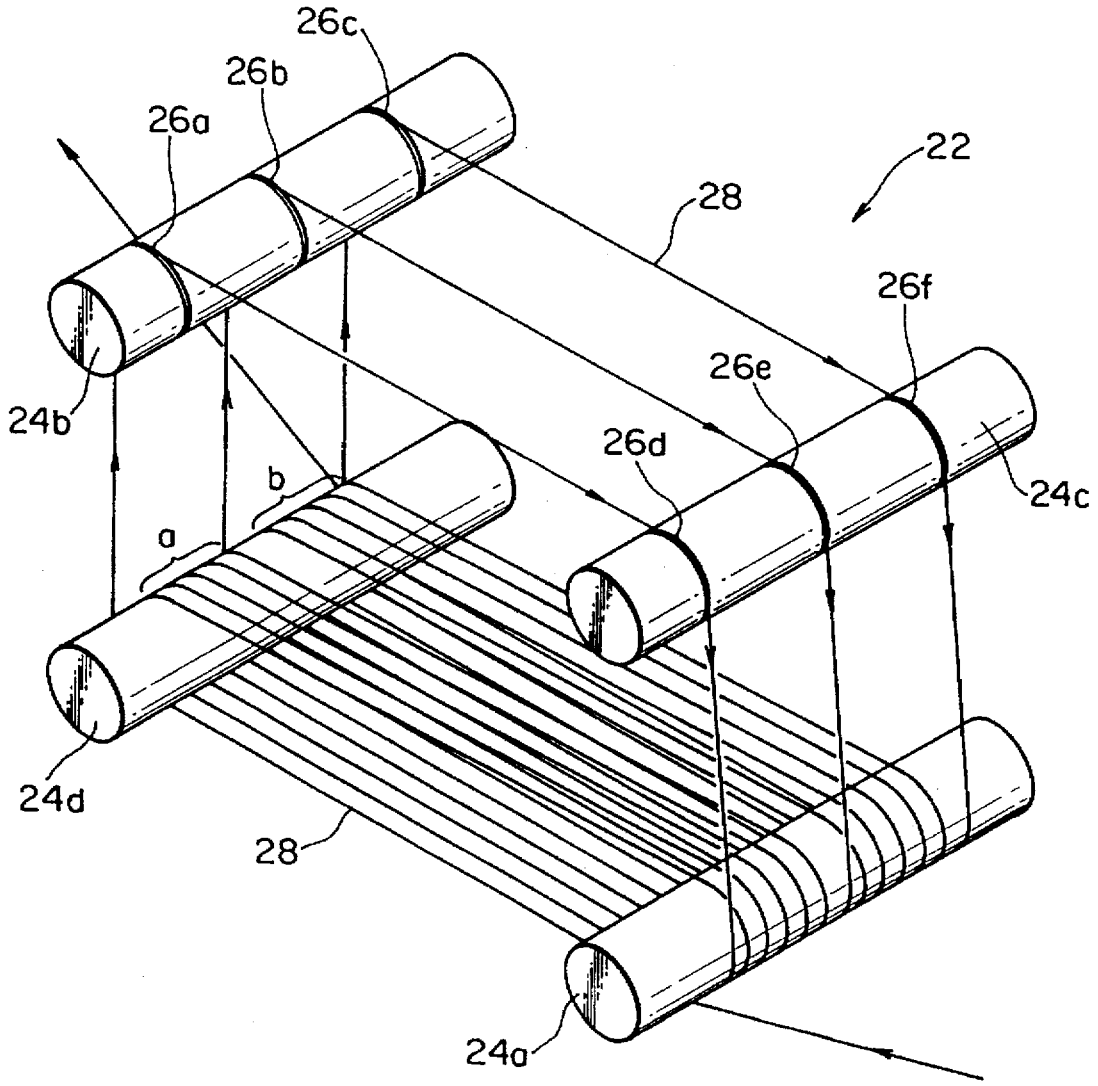
FIG. 4 is a schematic, perspective view illustrating another embodiment of the configuration of main rollers and a wire according to the present invention.

Referring to FIG. 4, a case that an ingot G is cut into rods by means of a wire saw 22 which comprises four rollers 24*a* to 24*d* and four wire portions to engage in cutting the ingot will be described.

The wire winds in a first group of annular grooves 26*a*, 26*b*, 26*c* and a second group of annular grooves 26*d*, 26*e*, 26*f* respectively around a pair of main rollers 24*b*, 24*c*. Another pair of rollers 24*a*, 24*d* are located in corresponding positions parallel to the rollers 24*b*, 24*c*. One or both of the rollers 24*a*, 24*d* may be used as a drive roller.

Figure 5:
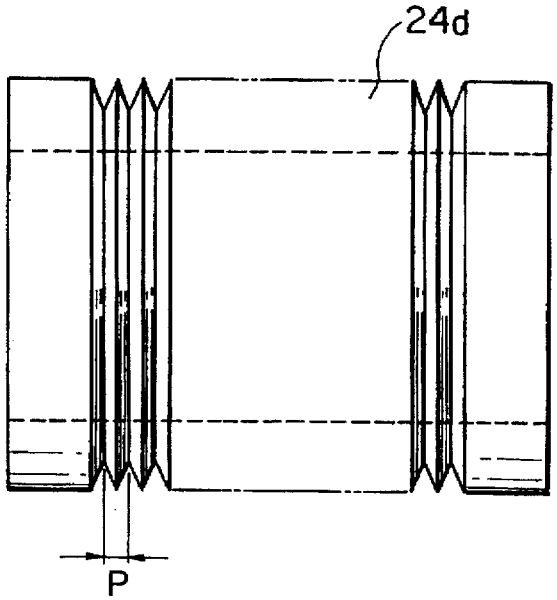
FIG. 5 is an enlarged view of part of a main roller, other than a main roller in the cutting area, of a further embodiment of the wire saw according to the present invention.

The rollers 24*a*, 24*d* have a groove pitch of 5 mm or less (FIG. 5). Breaking-down and skipping over a groove or grooves are prevented by the use of the width of the grooves. The diameter of a circumscribed circle in a plane perpendicular to each of the axes of the rollers 24*b*, 24*c* the periphery of which coincides with the projections of the lowest points of the bottoms of the annular grooves 26*a* to 26*c* or 26*d* to 26*f* is equal to the diameter of another circumscribed circle in a plane perpendicular to each of the axes of the rollers 24*a*, 24*d* the periphery of which coincides with the projections of the lowest points of the bottoms of the grooves of one of the rollers 24*a*, 24*d*.

The wire 28 runs from the roller 24*a* over the roller 24*d* to reach the groove 26*a* of the roller 24*b*. It runs over the roller 24*b* in the groove 26*a* to reach and wind around the roller 24*a* by way of the groove 26*d* of the roller 24*c*.

The wire 28 winds around parts a, a respectively of the rollers 24*a*, 24*d* therebetween a plurality of times and then it advances from the roller 24*d* to the groove 26*b* of the roller 24*b* to turn thereround. The wire 28 comes out of the groove 26*b* of the roller 24*b* and returns back to the roller 24*a* by way of the groove 26*e* of the roller 24*c*.

The wire 28 winds respectively around parts b, b a distance along the rollers 24*a*, 24*d* therebetween a plurality of times and then the wire 28 advances to the groove 26*c* of the roller 24*b* from the roller 24*d*.

The wire 28 further winds over the roller 24*c* in the groove 26*f* and connects with a take-up drum not shown by way of the rollers 24*a*, 24*d*.

In such a manner as mentioned above, the wire 28 is smoothly transferred from one groove to the next along the rollers 24*b*, 24*c* by winding the wire 28 around both of the rollers 24*a*, 24*d* a plurality of times through a length corresponding to a pitch of the grooves in the main rollers 24*b*, 24*c*, even when the pitch is large.

Figure 6:
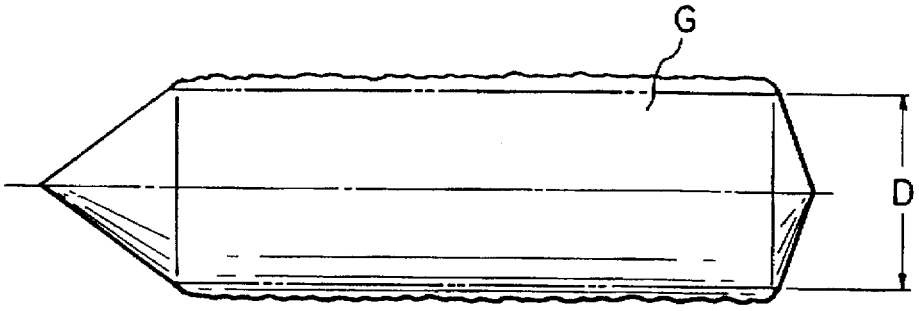
FIG. 6 is a schematic view of an as-grown semiconductor single crystal ingot.

A process for cutting an ingot into rods and then slicing the rods into wafers using the wire saw 22 according to the present invention will be described in reference to FIGS. 6 to 13. First, a single crystal is grown in a conventional manner to obtain an as-grown single crystal ingot G (FIG. 6). The as-grown single crystal G has an error of a maximum of ±2° in crystallographic orientation of growth under influence of the growth conditions.

Figure 7:
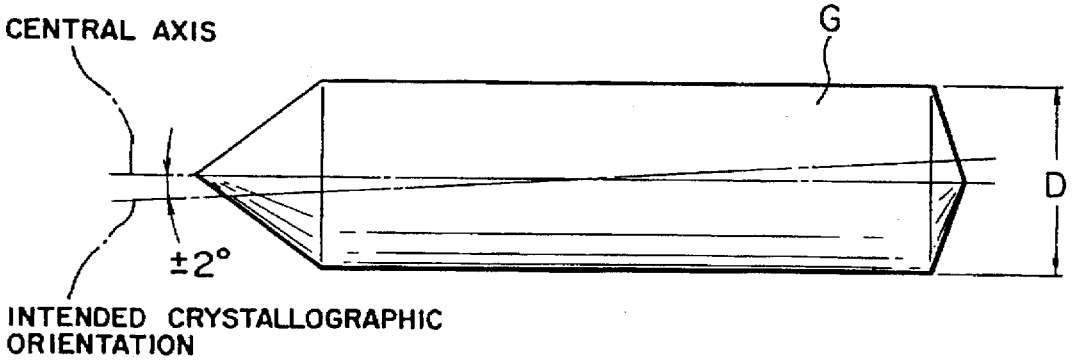
FIG. 7 is a schematic view of the ingot after cylindrical grinding.

The as-grown single crystal ingot is then processed by means of a centerless grinder to make the diameter uniform across almost all the length of the ingot in a conventional manner (FIG. 7).

Figure 8:
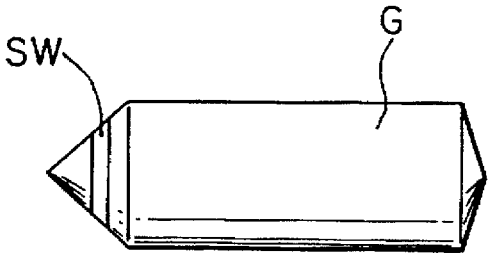
FIG. 8 is an illustrative presentation showing a test wafer to be sliced from an ingot for measurement of a crystallographic orientation.

A wafer SW is sampled by slicing in the cone by means of an inner peripheral slicing machine or a wire saw (FIG. 8).

Figure 9:
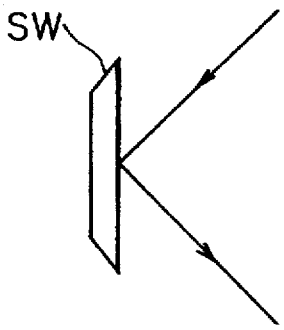
FIG. 9 is an illustrative presentation showing the test wafer and x rays incident and reflecting, FIG. 10 schematic, perspective view showing a cylindrically ground ingot and a workpiece holder therefor which is shiftable for adjusting a crystallographic orientation of the ingot according to the present invention.

The crystallographic orientation of a surface of the wafer SW is measured by means of an X ray crystallographic orientation measuring means (FIG. 9).

Figure 10:
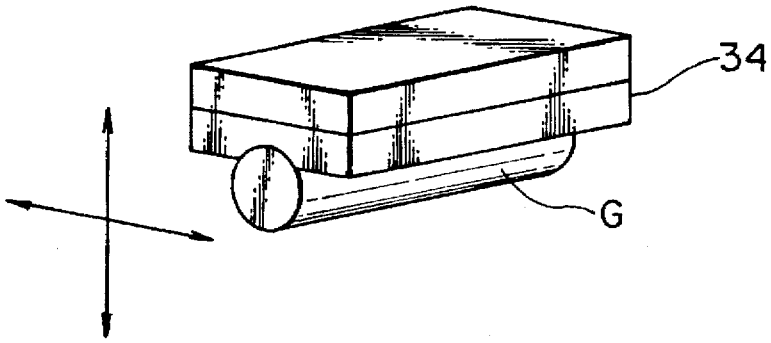

Realignment of the position of the single crystal ingot G is carried out within an error of ±6' on the basis of the result of X ray measurement on the wafer SW through adjustment of the position of the ingot holder by means of the mechanism for adjusting a crystallographic orientation, for example, a tilting mechanism with which the ingot holder is tilted in directions both of which are perpendicular to each other (FIG. 10).

Figure 13:
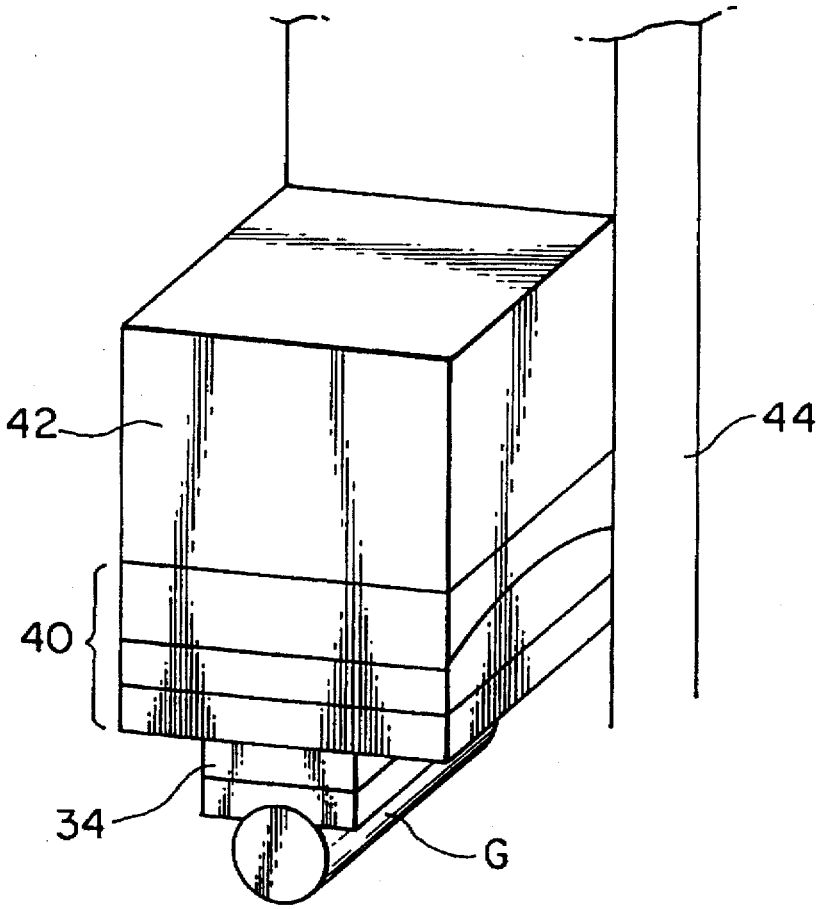
FIG. 13 is a schematic, perspective view showing an extraction of an embodiment of the tilting mechanism used in a wire saw according to the present invention.
Figure 14:
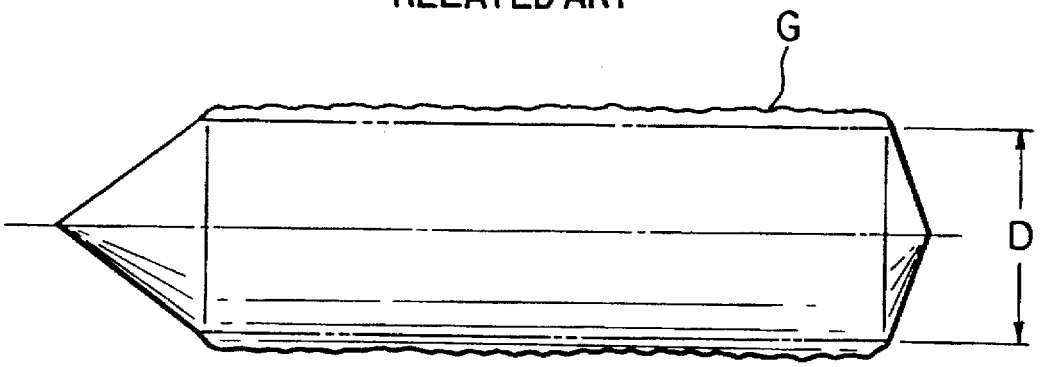
FIG. 14 RELATED ART
FIG. 14 is another schematic view of an as-grown semiconductor single crystal ingot.
Figure 15:
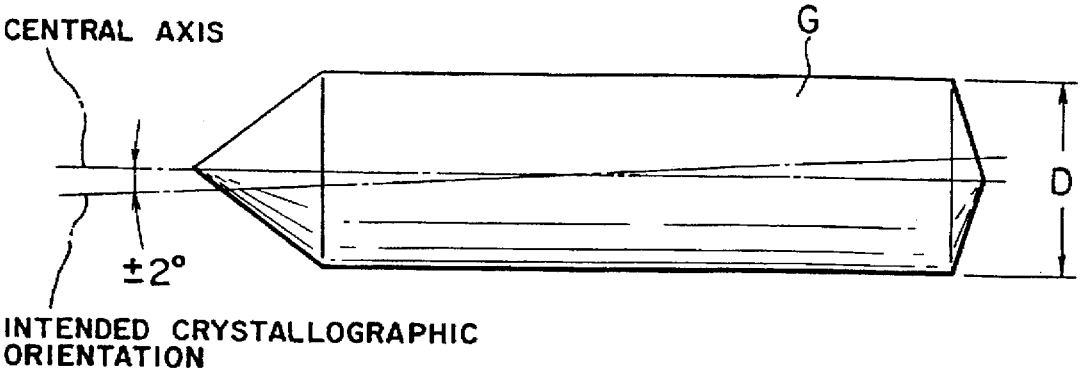
FIG. 15 RELATED ART
FIG. 15 is another schematic view of the ingot after cylindrical grinding.
Figure 16:
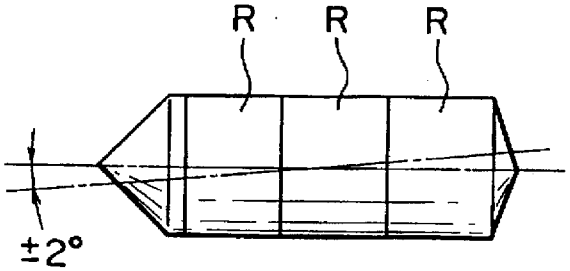
FIG. 16 RELATED ART
FIG. 16 is an illustrative presentation showing rods to be divided by slicing according to a conventional method.

In FIG. 13, an example of the tilting mechanism 40 which has a function that the ingot G held by the workpiece holder 34 is tilted in two direction which are perpendicular to each other is shown.

In FIG. 13, 42 indicates a drive unit for vertical shifting of a workpiece G and 44 indicates a support for vertical shifting of a workpiece G.

Figure 11:
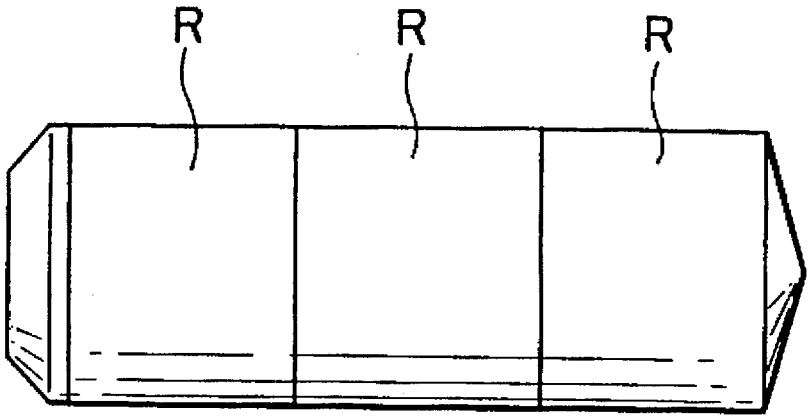
FIG. 11 is an illustrative presentation showing rods to be divided by slicing according to the present invention.
Figure 12:
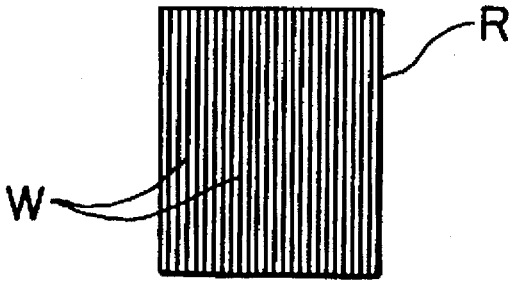
FIG. 12 is an illustrative presentation showing wafers to be sliced by slicing according to the present invention.

The single crystal ingot G thus adjusted in regard to crystallographic orientation is cut into rods B by means of the wire saw 22 according to the present invention. The cut end surfaces have each a predetermined crystallographic orientation with an accuracy of ±6' (FIG. 11).

Figure 17:
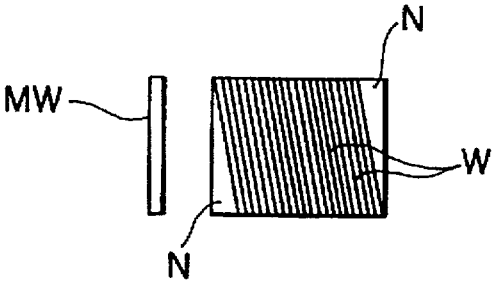
FIG. 17 RELATED ART
FIG. 17 is an illustrative presentation showing wafers to be sliced by slicing according to the conventional method.
Figure 18:
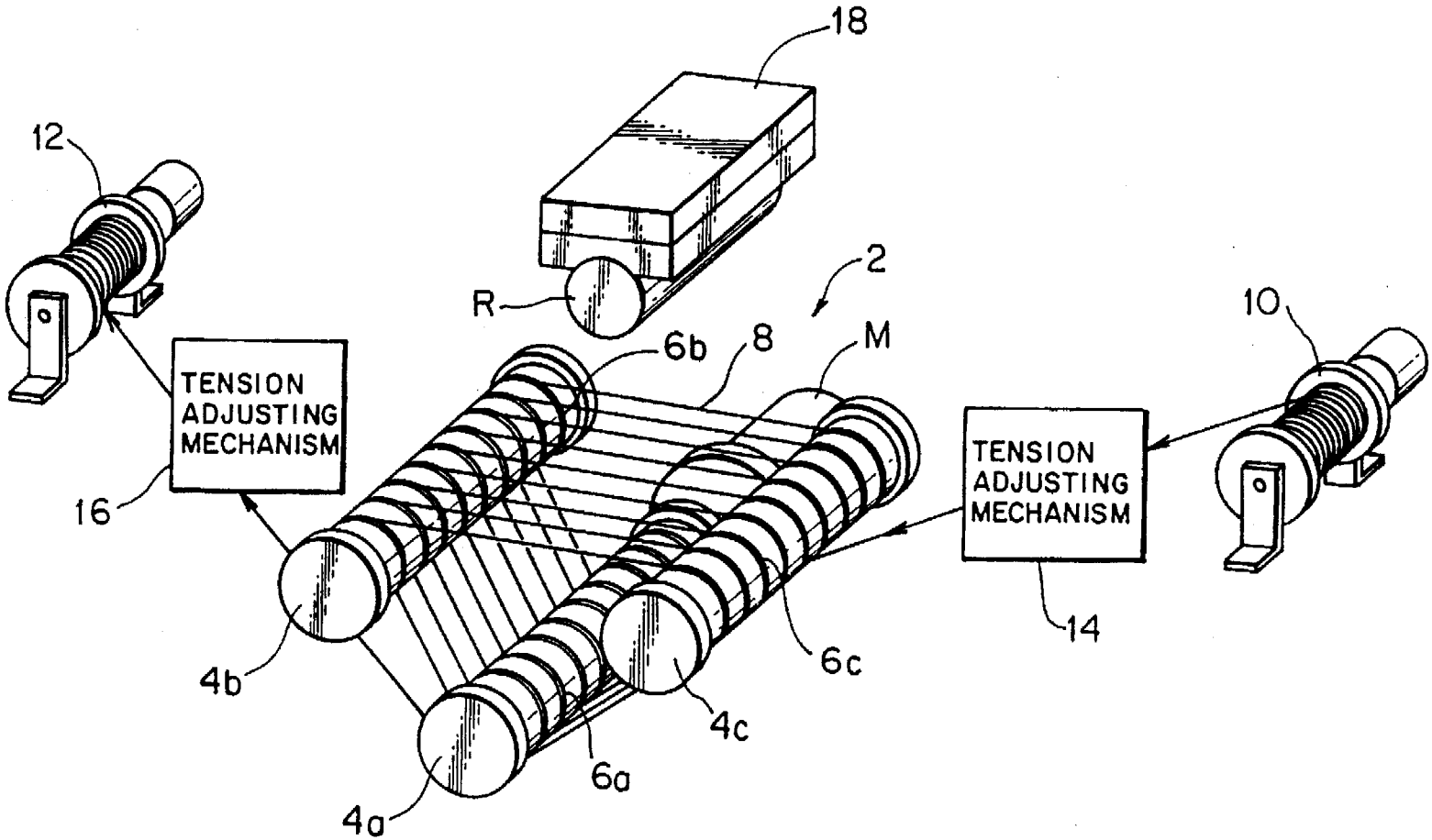
FIG. 18 RELATED ART
FIG. 18 is a schematic, perspective view illustrating an example of the conventional wire saw.

Each rod B is then sliced into thin disks or wafers by an inner peripheral slicing machine with no kerf loss at both end surfaces (FIG. 12) instead of a large kerf loss in a conventional case (FIG. 17).

We claim:

1. A wire saw for cutting a workpiece comprising:

a plurality of main rollers three-dimensionally arranged with a predetermined distance between each other in a position of being mutually in parallel;

a wire running over all the main rollers a plurality of times to form arrays of wire portions, in a traversing manner, parallel to each other between pairs of successive main rollers;

a workpiece holder for holding a workpiece having a longitudinal axis above a first array of wire portions and pressing the workpiece onto the first array of wire portions during cutting of the workpiece;

first and second tension adjusting mechanisms for adjusting a tension of the wire;

a drive motor for moving the wire by way of actuating a main roller; and means for supplying slurry on at least the first array of wire portions, wherein the wire wraps around all the main rollers a plurality of times in a ratio of one time between a pair of successive main rollers bordering the first array of wire portions to more than one time over at least one remaining main roller with a desired constant distance spaced between each pair of successive wire portions along the pair of successive main rollers bordering the first array of wire portions and the workpiece is cut into a plurality of rods which are held fixedly on the workpiece holder before, during and after being cut.

2. A wire saw according to claim 1 wherein the workpiece is a semiconductor single crystal ingot.

3. A wire saw according to claim 2, wherein the desired constant distance between each pair of successive wire portions corresponds to a length of each rod into which a semiconductor ingot is to be cut.

4. A wire saw according to claim 1, wherein the desired constant distance between each pair of successive wire portions corresponds to a length of each rod into which a semiconductor ingot is to be cut.

5. A wire saw according claim 4 wherein a diameter of the wire is in the range of 0.16 mm to 0.32 mm.

6. A wire saw according to claim 4, wherein the wire saw comprises three main rollers, including the pair of successive main rollers bordering the first array of wire portions, and the wire winds exclusively around a remaining main roller one or more times in a length along the other remaining main roller.

7. A wire saw according to claim 6, wherein grooves are formed in the periphery of each of the pair of successive main rollers bordering the first array of wire portions at a desired constant distance spaced between each pair of successive grooves along the pair of successive main rollers bordering the first array of wire portions and no grooves are formed in the periphery of the remaining main roller.

8. A wire saw according to claim 4, wherein the wire saw comprises four main rollers, including the pair of successive main rollers bordering the first array of wire portions, and the wire winds exclusively around two remaining main rollers as a group one or more times for a certain length along the two remaining main rollers.

9. A wire saw according to claim 8, wherein grooves are formed in the periphery of each of the pair of successive main rollers bordering the first array of wire portions at the desired constant distance between each pair of successive grooves, the desired constant distance being equal to the length of each rod, and other grooves are formed in the periphery of each of the remaining main rollers at a second constant distance between each pair of successive grooves, the second constant distance being 5 mm or less.

10. A wire saw according to claim 4, wherein the wire saw further comprises a mechanism for adjusting a longitudinal direction of the workpiece.

11. A wire saw according to claim 1, wherein the wire saw comprises three main rollers, including the pair of successive main rollers bordering the first array of wire portions, and the wire winds exclusively around a remaining main roller one or more times in a length along the remaining main roller.

12. A wire saw according to claim 11 wherein a diameter of the wire is in the range of 0.16 mm to 0.32 mm.

13. A wire saw according to claim 11, wherein grooves are formed in the periphery of each of the pair of successive main rollers bordering the first array of wire portions at a desired constant distance spaced between each pair of successive grooves along the pair of successive main rollers bordering the first array of wire portions and no grooves are formed in the periphery of the remaining main roller.

14. A wire saw according to claim 11, wherein the wire saw further comprises a mechanism for adjusting a longitudinal direction of the workpiece.

15. A wire saw according to claim 1, wherein the wire saw comprises four main rollers, including the pair of successive main rollers bordering the first array of wire portions, and the wire winds exclusively around two remaining main rollers as a group one or more times for a certain length along the two remaining main rollers.

16. A wire saw according to claim 15 wherein a diameter of the wire is in the range of 0.16 mm to 0.32 mm.

17. A wire saw according to claim 15, wherein grooves are formed in the periphery of each of the pair of successive main rollers bordering the first array of wire portions at the desired constant distance between each pair of successive grooves, the desired constant distance being equal to the length of each rod, and other grooves are formed in the periphery of each of the remaining main rollers at a second constant distance between each pair of successive grooves, the second constant distance being 5 mm or less.

18. A wire saw according to claim 15, wherein the wire saw further comprises a mechanism for adjusting a longitudinal direction of the workpiece.

19. A wire saw according to claim 1, wherein the wire saw further comprises a mechanism for adjusting a longitudinal direction of the workpiece.

20. A wire saw according to claim 1 wherein a diameter of the wire is in the range of 0.16 mm to 0.32 mm.

* * * * *